US007055948B2

(12) United States Patent
McNally et al.

(10) Patent No.: US 7,055,948 B2
(45) Date of Patent: Jun. 6, 2006

(54) VOLTAGE CONTROL FOR CAPACITIVE MAT

(75) Inventors: Stephen McNally, Vancouver, WA (US); Robert M. Yraceburu, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 229 days.

(21) Appl. No.: 10/629,414

(22) Filed: Jul. 29, 2003

(65) Prior Publication Data

US 2005/0024460 A1 Feb. 3, 2005

(51) Int. Cl.
*B41J 2/01* (2006.01)

(52) U.S. Cl. ..... 347/104; 271/193

(58) Field of Classification Search ..... 347/104, 347/101, 16, 2, 4; 271/193
See application file for complete search history.

(56) References Cited

U.S. PATENT DOCUMENTS 3,220,303 A * 11/1965 Stowell ..... 347/112
3,973,770 A * 8/1976 Montenbruck ..... 271/272
4,856,769 A * 8/1989 Andrew et al. ..... 271/193
5,121,170 A * 6/1992 Bannai et al. ..... 399/303
5,224,693 A * 7/1993 Taguchi et al. ..... 271/9.11
5,530,459 A * 6/1996 Kline et al. ..... 346/136
5,593,151 A * 1/1997 Mashtare et al. ..... 271/193
5,877,790 A 3/1999 Hagiwara et al.
5,975,683 A 11/1999 Smith et al.
6,079,814 A 6/2000 Lean et al.
6,164,761 A * 12/2000 Numata ..... 347/55
6,309,064 B1 * 10/2001 Tanno et al. ..... 347/104
6,375,184 B1 * 4/2002 Hayashi ..... 271/18.1
6,508,540 B1 1/2003 Lean et al.
2003/0052955 A1 * 3/2003 Kanome ..... 347/104

FOREIGN PATENT DOCUMENTS

JP 2002193470 A * 7/2002

* cited by examiner

*Primary Examiner*—Manish Shah
*Assistant Examiner*—Leonard Liang

(57) ABSTRACT

Representative embodiments provide for a controller for use with a capacitive mat, the controller configured to selectively electrically energize a first node of the capacitive mat in response to an input. The controller is further configured to wait for a first predetermined period of time, and to electrically energize a second node of the capacitive mat after the first predetermined period time. A method of the present invention provides for controlling a capacitive mat, the method including receiving an input, (and electrically energizing a first node of the capacitive mat at a first predetermined potential. The method also includes waiting for a first predetermined period of time, and electrically energizing a second node of the capacitive mat after the first predetermined period of time.) This repeats the scenario stated in lines 5–7. The abstract only mentions one of the three methods.

4 Claims, 5 Drawing Sheets

VOLTAGE CONTROL FOR CAPACITIVE MAT

BACKGROUND

Various kinds of imaging apparatuses that are configured to form images on sheet media are known. Some such apparatuses form images on sheet media in correspondence to an electronic document file, commonly referred to as a print job. Other types of imaging apparatus perform their imaging function in response to optically scanning an image-bearing sheet media. Thus, examples of imaging apparatuses include laser printers, inkjet printers, thermal imaging devices, photocopiers, etc.

Generally, such imaging apparatuses temporarily secure the sheet media in a registered relationship with an imaging engine (i.e., inkjet print head, etc.) during the image forming process so as to achieve the desired image placement on the media. One kind of device used to temporarily secure sheet media is the capacitive mat. Broadly speaking, capacitive mat devices typically include a number of electrically charged conductors, usually arranged as a grid or matrix within a layer of nonconductive material, to support a sheet of media in registered orientation by way of capacitive (i.e., electrostatic) attraction.

One generally undesirable aspect of capacitive mats is the tendency for the layer of nonconductive material to develop a residual electrostatic charge (known as polarization) over the course of operative time. This polarization tends to reduce the efficiency or 'holding power' of the capacitive mat with respect to the supported sheet media. Such loss of holding power can lead to movement and/or mis-registration of the sheet media supported by the capacitive mat during operation, resulting in undesirable or unacceptable imaging quality or media jams thereon.

Therefore, it is desirable to provide methods and apparatus for use with capacitive mats that address the polarization problems discussed above.

SUMMARY

One embodiment of the present invention provides a sheet media support apparatus, including a capacitive mat including electrical first and second nodes. The capacitive mat is configured to electrically attractingly support a sheet media. The apparatus further includes a controller, which is coupled to the first and second nodes of the capacitive mat. The controller is configured to selectively electrically energize the first node at a first predetermined potential in response to an input, and to wait for a first predetermined period of time. The controller is also configured to electrically energize the second node at a second predetermined potential after the first predetermined period of time.

Another embodiment of the present invention provides for a sheet media support apparatus, including a capacitive mat. The capacitive mat includes electrical first and second nodes, and is configured to electrically attractingly support a sheet media. The apparatus further includes a controller coupled to the first and second nodes of the capacitive mat. The controller is, in turn, configured to selectively electrically energize the first node at a time-increasing positive potential in response to an input, and to electrically energize the second node at a time-increasing negative potential contemporaneous with the energizing the first node.

Still another embodiment of the present invention provides a sheet media support apparatus, including a capacitive mat including electrical first and second nodes. The capacitive mat is configured to electrically attractingly support a sheet media. The apparatus also includes a controller coupled to the first and second nodes of the capacitive mat. The controller is configured to selectively electrically energize the first node at a first predetermined positive potential, and to electrically energize the second node at a first predetermined negative potential in response to an input. The controller is further configured to wait for a first predetermined period of time, and to electrically energize the first node at a second predetermined positive potential and electrically energize the second node at a second predetermined negative potential after the first predetermined period of time.

Yet another embodiment provides for a method of controlling a capacitive mat, the method including receiving an input, and electrically energizing a first node of the capacitive mat at a first predetermined potential. The method further includes waiting for a first predetermined period of time, and electrically energizing a second node of the capacitive mat after the first predetermined period of time.

These and other aspects and embodiments will now be described in detail with reference to the accompanying drawings, wherein:

DETAILED DESCRIPTION

In representative embodiments, the present teachings provide methods and apparatus for controlling a capacitive mat suitable for the registered support of a sheet media, typically within an imaging apparatus. In general, such methods of the present invention utilize any number of suitable sequences or signal patterns for energizing a capacitive mat and typically include such characteristics as one or more step changes in electrical potential, linear and/or non-linear ramping of (i.e., time-varying) electrical potential, or any suitable combination of these or other electrical energization characteristics. Such methods and apparatus of the present invention provide for the substantial elimination of the polarization problems described above.

Figure 1:
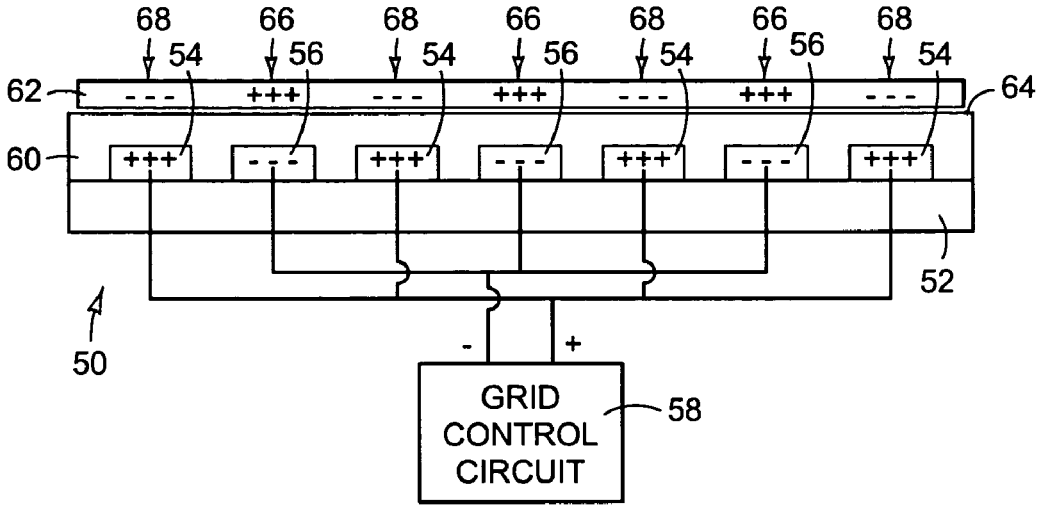
FIG. 1 (Prior Art)
FIG. 1 is a side elevation sectional view depicting a capacitive mat according to the prior art.

Turning now to FIG. 1, a side elevation sectional view depicts a capacitive mat 50 according to the prior art. The capacitive mat 50 includes a non-conductive base material (i.e., substrate) 52. As depicted in FIG. 1, the substrate 52 supports a plurality of generally positive conductors 54 and a plurality of generally negative conductors 56. The positive conductors 54 and the negative conductors 56 are assumed to extend away from the viewer, and are alternately arranged so as to generally define an inter-digitated, conductive grid or matrix on the substrate 52. The pluralities of conductors 54 and 56 are electrically coupled to respective positive and negative electrical connections on a grid control circuit 58.

The capacitive mat 50 further includes a non-conductive (i.e., dielectric) cover material 60 that overlies and substantially encapsulates the pluralities of conductors 54 and 56 in generally fixed relationship with one another, the substrate 52, and the cover material 60. In this way, the positive conductors 54 and the negative conductors 56 are substantially isolated against contact with entities outside of the capacitive mat 50 (with the exception of electrical coupling to the grid control circuit 58). Further depicted in FIG. 1 is a sheet of media 62, which is generally supported on a surface 64 defined by the cover material 60.

Typical operation of the capacitive mat 50 is as follows: to begin, it is assumed that the sheet of media 62 is deposited (i.e., delivered) in resting support on the surface 64 of the capacitive mat 64 by way of a suitable delivery mechanism (not shown). The grid control circuit 58 then electrically energizes the positive conductors 54 and the negative conductors 56 such that a generally constant, predetermined electrical potential exists between these two respective pluralities.

The electric field corresponding to the energized pluralities of conductors 54 and 56 causes a corresponding migration of electrical charge within the sheet media 62, such that regions of positive charge 66 generally accumulate within the sheet media 62 over each of the negative electrodes 56, while regions of negative charge 68 generally accumulate over each of the positive electrodes 54. As a result, a capacitive (electrostatic) hold-down or 'tacking' force is exerted on the sheet media 62, which serves to support the sheet media 62 in a substantially registered orientation with respect to the capacitive mat 50 and/or other entities (not shown).

Eventually, the need to hold-down or register the sheet media 62 with the respect to the capacitive mat 50 ends. At such time, the grid control circuit 58 de-energizes the positive conductors 54 and the negative conductors 56, resulting in the substantial release of the sheet media 62.

Over the course of time, the capacitive mat 50, electrostatic charges (not shown) tend to accumulate within the dielectric cover material 60. This charge accumulation within the cover material 60 is referred to as polarization. These polarization charges (not shown) generally mimic those that are induced within the sheet media 62 and are opposite the charges of the conductors 54 and 56 during operation.

The polarization charges tend to oppose the accumulation of the charges 66 and 68, thus resulting in a general decreasing of the tacking or hold-down force exerted on the sheet media 62 by the capacitive mat 50. If the magnitude of the polarization becomes too severe, the hold-down force can become insufficient to maintain proper registration of the sheet media 62 during imaging or other associated operations. Undesirable degradation in imaging quality, media jams, or media crashing into the pens can, in turn, result.

Methods and apparatus of the present invention, described hereafter, address this problem.

Figure 2:
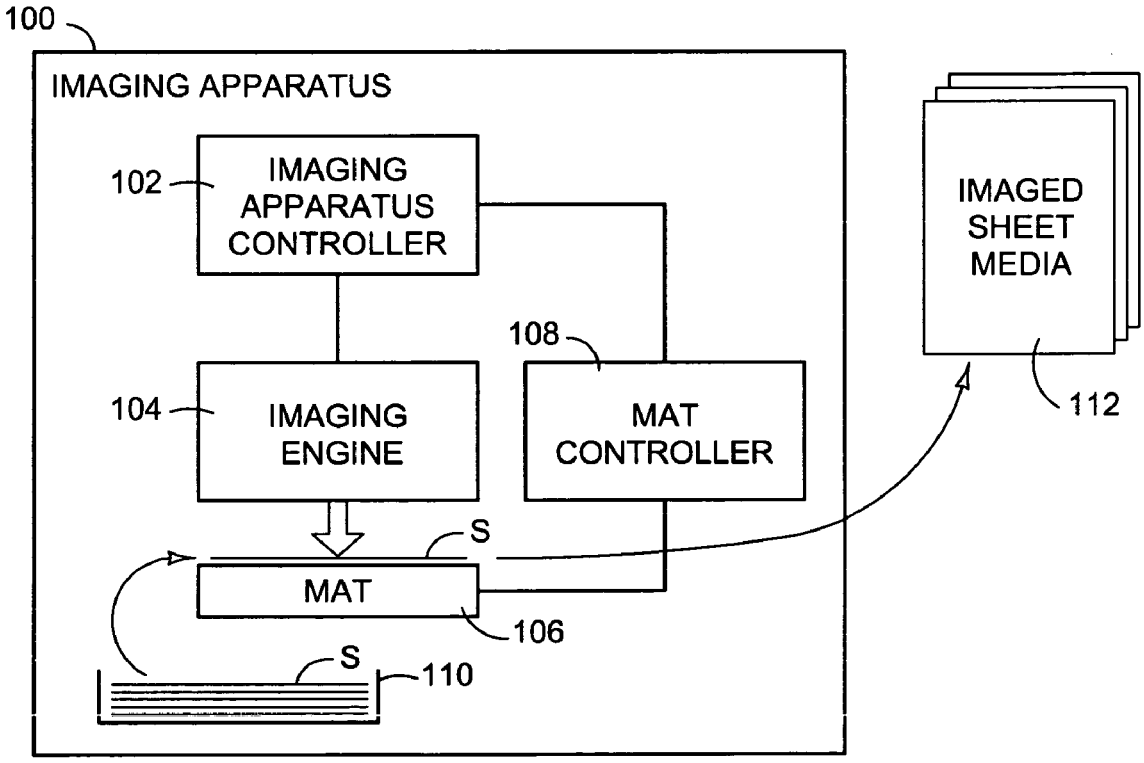
FIG. 2 is a block diagram depicting an imaging apparatus in accordance with an embodiment of the present invention.

FIG. 2 is a block diagram depicting an imaging apparatus 100 in accordance with an embodiment of the present invention. The imaging apparatus 100 includes an imaging apparatus controller (hereafter, controller) 102. The controller 102 can typically include any controller suitable for controlling typical normal operation of the imaging apparatus 100. As such, the controller 102 can include, for example: a microprocessor or microcontroller; a solid-state memory or other computer-accessible storage media; a state machine; digital, analog, and/or hybrid electronic circuitry; sensing instrumentation; etc. One of skill in the electronic control arts can appreciate that various embodiments of the controller 102 can be used in correspondence with differing embodiments of the imaging apparatus 100 and that further elaboration is not required for an understanding of the present invention.

The imaging apparatus 100 also includes an imaging engine 104. The imaging engine 104 is generally coupled in controlled relationship with the controller 102. The imaging engine 104 can be defined by any such imaging engine suitable for selectively forming images on sheet media "S" (described in detail hereafter) under the control of the controller 102. For example, the controller 104 can include an inkjet imaging engine, etc. Other suitable embodiments of the imaging engine 104 can also be used.

The imaging apparatus 100 also includes a capacitive mat 106. The capacitive mat 106 can be generally defined by any capacitive mat suitable for use with the present invention. The capacitive mat 106 is generally configured to controllably support a sheet media S in registered orientation with the imaging engine 104 (or other suitable elements of the imaging apparatus 100, not shown) during normal operation. The capacitive mat 106 is configured to provide such registered support of the sheet media S by way of electrical (i.e., capacitive, or electrostatic) attraction under the control of a mat controller 108 (described hereafter). Further elaboration of the capacitive mat 106 is provided hereafter.

The imaging apparatus 100 further includes the mat controller 108 of the present invention introduced above. The mat controller 108 can include any electronic circuitry suitable for electrically coupling the capacitive mat 106 to a source or sources of electrical energy (not shown) under the control signal influence of the controller 102 and in accordance with the methods of the present invention. Thus, the mat controller 108 can include, for example: digital, analog and/or hybrid electronic circuitry; signal amplifying circuitry; electrical switching devices; a microprocessor or microcontroller; etc.; or any combination of these or other suitable circuit elements. It can be appreciated by one of skill in the electrical arts that varying embodiments of the mat controller 108 can be used in accordance with the present invention, and that more particular elaboration is not required for purposes herein. It will also be appreciated that the mat controller 108 can be provided by components within the imaging apparatus controller 102, described above.

It is to be understood that the imaging apparatus 100 also typically includes other elements and devices not specifically shown in FIG. 2. Such other elements can include, for example: an electrical energy source or sources; an operator interface; input/output circuitry; optical scanning devices; sheet media transport and routing mechanisms; etc. These and other elements and devices can be selectively included in varying embodiments of the imaging apparatus 100 as required or desired for typical respective operation thereof.

Normal operation of the imaging apparatus 100 is generally as follows: the controller 102, in response to receiving an electronic document file (not shown), causes sheet media S to be drawn from an input tray 110 and routed to the capacitive mat 106. The controller 102 then causes the mat controller 108 to energize (i.e., electrically couple an energy source or sources to) the capacitive mat 106 in accordance with the methods of the present invention. Energizing of the capacitive mat 106 by way of the mat controller 108 generally results in the capacitive (i.e., electrostatic) attraction of the sheet media S into supported registration with the imaging engine 104. This capacitive attraction is generally referred to as hold-down or tacking force.

The controller 102 then causes the imaging engine 104 to selectively form images on the registered, supported sheet media S in accordance with the electronic document file. The controller 102 thereafter causes the mat controller 108 to de-energize the capacitive mat 106, effectively halting the capacitive attraction between the imaged sheet media S and the capacitive mat 106. The controller 102 then causes the imaged sheet media S to be suitably transported generally out of the imaging apparatus 100.

The process described above is typically repeated, one sheet of media S at a time, until the electronic document file has been completely imaged on the sheet media S. The imaged sheet or sheets of media generally define an imaged document 112.

Because the capacitive mat 106 is controlled in accordance with the methods of the present invention (described in detail hereafter), the polarization effect described above in regard to the capacitive mat 50 of FIG. 1 is substantially negated. Thus, the capacitive mat 106, under the influence of the mat controller 108, exerts a substantially controllable, non-degrading hold-down (tacking) force upon sheets of media S over the course of its useful life.

Figure 3:
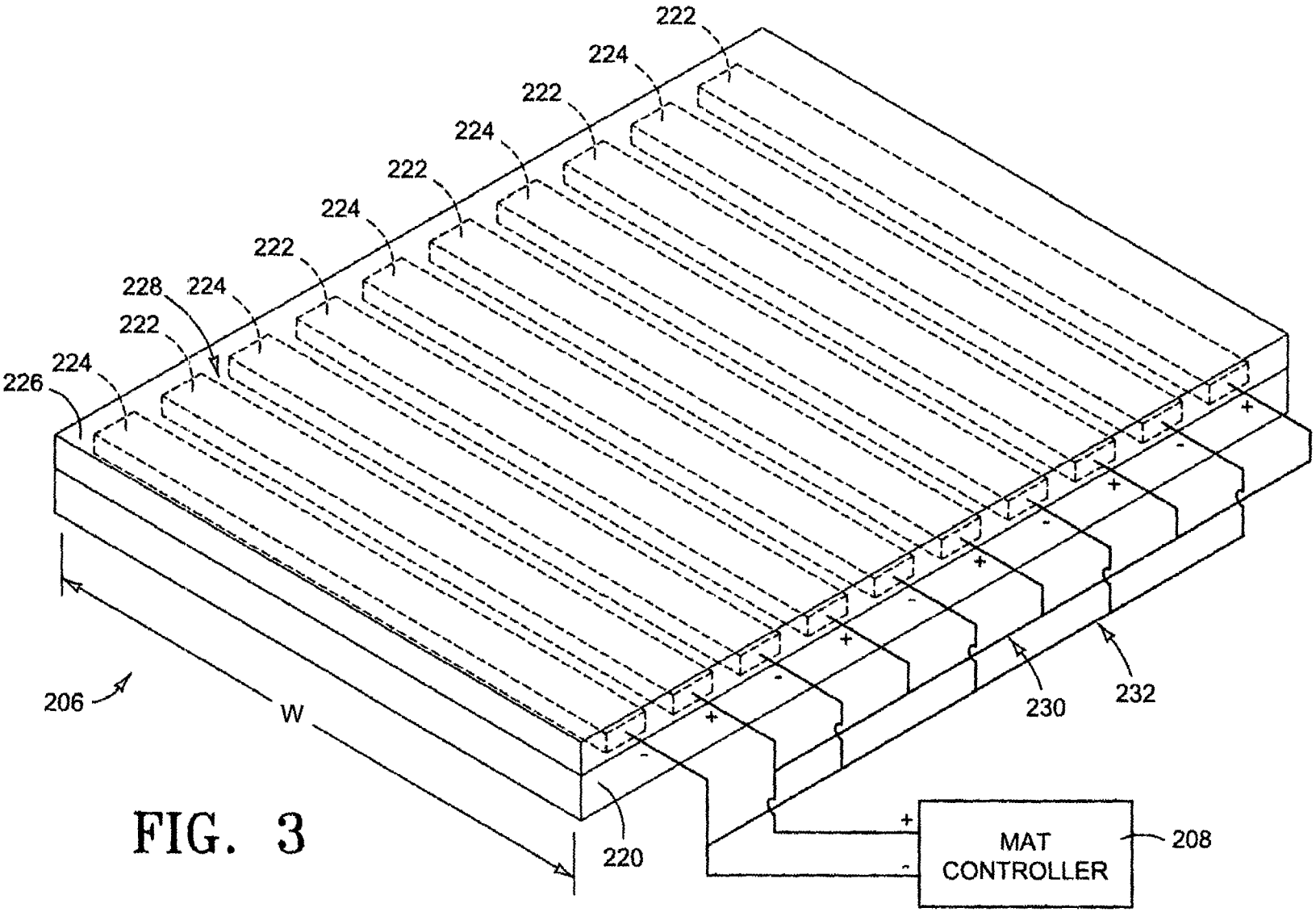
FIG. 3 is a perspective view depicting a capacitive mat in accordance with another embodiment of the present invention.

FIG. 3 is a perspective view depicting a capacitive mat 206 in accordance with another embodiment of the present invention. The capacitive mat 206 can be used as the capacitive mat 106 of FIG. 2. The capacitive mat 206 includes a non-conductive (i.e., dielectric) substrate 220. The substrate 220 can be formed from any suitable dielectric material, such as, for example, plastic, glass, silicon dioxide, etc. Other materials can also be used to form the substrate 220.

The capacitive mat 206 also includes a plurality of positive conductors 222, and a plurality of negative conductors 224. Each of the positive conductors 222 and the negative conductors 224 can be formed from any suitable electrically conductive material. Non-limiting examples of such electrically conductive material include copper, silver, conductively doped semiconductor, etc. Other suitable electrically conductive materials can also be used.

As depicted in FIG. 3, the positive conductors 222 are arranged in alternating, spaced, parallel placement with the negative conductors 224, such that a grid or matrix is defined and supported by the substrate 220. Each of the plurality of positive conductors 222 is electrically coupled to one another so as to define a single positive node 230. Similarly, each of the plurality of negative conductors 224 is electrically coupled to one another to define a single negative node 232. Each of the positive conductors 222 and the negative conductors 224 extends substantially across a widthwise dimension "W" of the capacitive mat 206. Furthermore, the particular count of positive conductors 222 and negative conductors 224 can vary selectively as desired in correspondence with different embodiments (not shown) of the capacitive mat 206.

The capacitive mat 206 further includes a dielectric cover material 226. The dielectric cover material can be formed from any suitable electrically non-conductive material such as, for example, plastic, glass, silicon dioxide, etc. Other suitable materials can also be used to form the cover material 226. The cover material 226 is configured to cooperate with the substrate 220 such that the positive conductors 222 and the negative conductors 224 are substantially encapsulated and isolated against physical contact with entities outside of the capacitive mat 206. The cover material 226 is further configured to define a substantially planar support surface 228.

Further depicted in FIG. 3 is a mat controller 208. The mat controller 208 is electrically coupled to the positive node 230 and the negative node 232 of the capacitive mat 206. The mat controller 208 can be defined by suitable mat controller in accordance with the present invention such as, for example, the mat controller 108 of FIG. 2. Thus, the mat controller 208 is generally configured to selectively energize the positive node 230 and the negative node 232 of the capacitive mat 206 in response to an appropriate input or signal, typically from an imaging apparatus controller (not shown, see the controller 102 of FIG. 2), in accordance with the methods of the present invention.

Typical operation of the capacitive mat 206 is generally as described above in regard to the capacitive mat 106 of FIG. 2. In this way, the capacitive mat 206 is generally configured to controllably exert an electrostatic hold-down force on a sheet of media (not shown) so as to maintain such a sheet of media in supportive registration during imaging operations within an imaging apparatus (not shown, see the imaging apparatus 100 of FIG. 2.).

Figure 4:
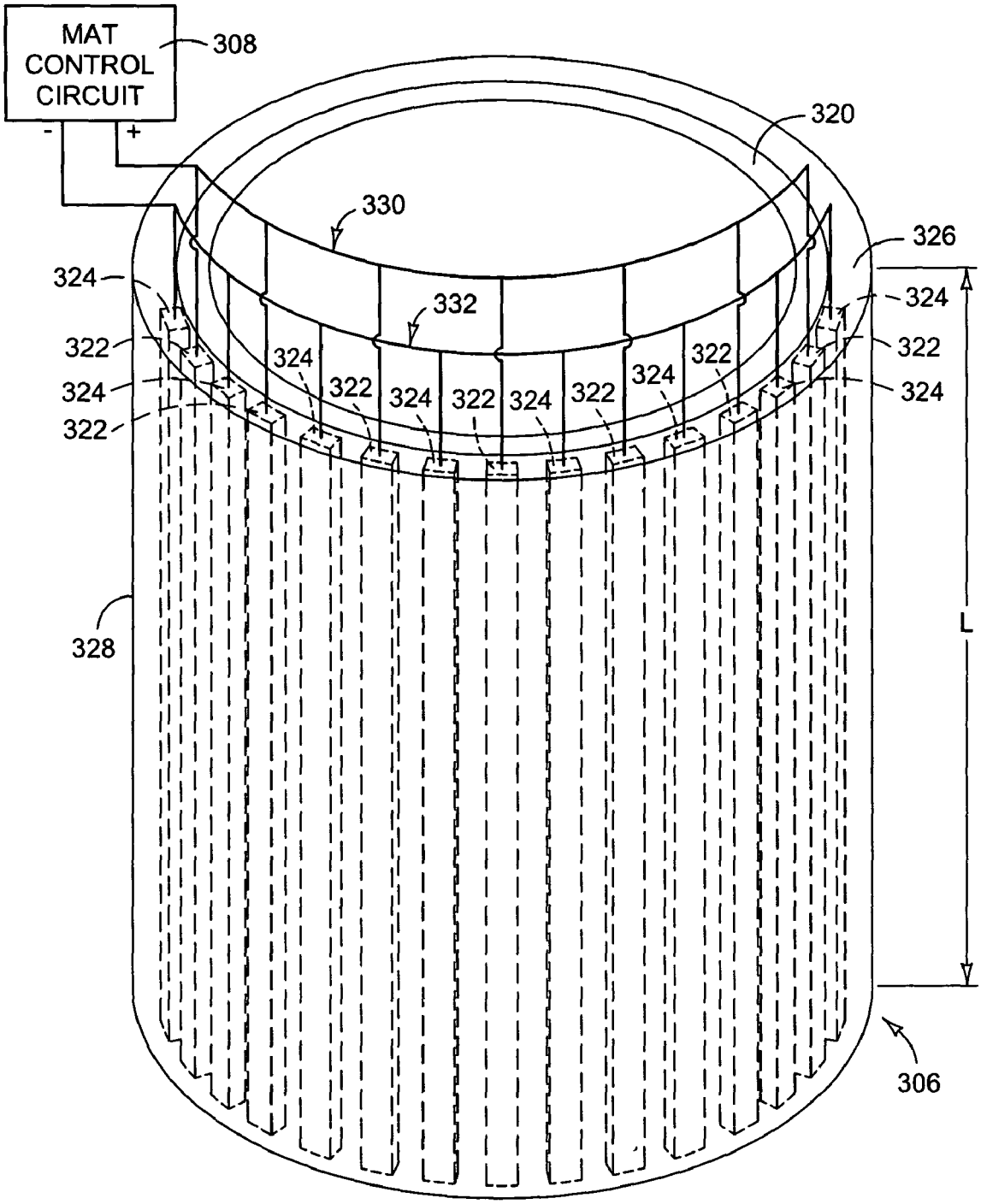
FIG. 4 is a perspective view depicting a capacitive mat in accordance with yet another embodiment of the present invention.

FIG. 4 is perspective view depicting a capacitive mat 306 in accordance with yet another embodiment of the present invention. The capacitive mat 306 includes a dielectric core or substrate 320. The substrate 320 can be formed from any suitable non-conductive material such as, for example, plastic, glass, silicon dioxide, etc. Other materials suitable for forming substrate 320 can also be used. As depicted in FIG. 4, the substrate 320 substantially defines a hollow cylinder. Other suitable geometries can also be used.

The capacitive mat 306 also includes a plurality of positive conductors 322, and a plurality of negative conductors 324. Each of the positive conductors 322 and the negative conductors 324 can be formed from any suitable electrically conductive material. Non-limiting examples of such electrically conductive material include copper, silver, conductively doped semiconductor, etc. Other suitable electrically conductive materials can also be used.

As shown in FIG. 4, the positive conductors 322 are arranged in alternating, spaced, parallel placement with the negative conductors 324, such that a grid or matrix is defined and supported by an outer surface of the generally cylindrical substrate 320. In this way, substantially one-half of the substrate 320 outer surface area is utilized to support the positive conductors 322 and the negative conductors 324. In another embodiment (not shown), a greater or lesser fraction of the substrate 320 outer surface area can be used to support conductors 322 and 324. In such an embodiment (not shown), the count of positive conductors 322 and negative conductors 324 can also vary selectively.

In any case, each of the plurality of positive conductors 322 is electrically coupled to one another so as to define a single positive node 330. Similarly, each of the plurality of negative conductors 324 is electrically coupled to one another to define a single negative node 332. Each of the positive conductors 322 and the negative conductors 324 extends substantially across a lengthwise dimension "L" of the capacitive mat 306.

The capacitive mat 306 further includes a dielectric cover material 326. The dielectric cover material can be formed from any suitable electrically non-conductive material such as, for example, plastic, glass, silicon dioxide, etc. Other suitable materials can also be used to form the cover material 326. The cover material 326 is configured to cooperate with the substrate 320 such that the positive conductors 322 and the negative conductors 324 are substantially encapsulated and isolated against physical contact with entities other than the capacitive mat 306. The cover material 326 is further configured to define a substantially flat, smooth, generally cylindrical support surface 328, in accordance with the geometry of the substrate (i.e., core) 320.

Further depicted in FIG. 4 is a mat controller 308. The mat controller 308 is electrically coupled to the positive node 330 and the negative node 332 of the capacitive mat 306. The mat controller 308 can be defined by suitable mat controller in accordance with the present invention such as, for example, the mat controller 108 of FIG. 2. Thus, the mat controller 308 is generally configured to selectively energize the positive node 330 and the negative node 332 of the capacitive mat 206 in response to an appropriate input or signal, typically from an imaging apparatus controller (not shown, see the controller 102 of FIG. 2), in accordance with the methods of the present invention.

Typical operation of the capacitive mat 306 is substantially as described above in regard to the capacitive mat 106 of FIG. 2. However, in contrast to the substantially planar geometry of the capacitive mat 206 of FIG. 3, the capacitive mat 306 electrostatically supports a sheet media (not shown) on the support surface 328 in a correspondingly arced or curved registration thereon. This arced registration of the supported sheet media (not shown) is generally desirable in some usage environments such as, for example, during the deposition of imaging media (not shown) onto the supported sheet media within a inkjet printer type of imaging apparatus (not shown, see the imaging apparatus 100 of FIG. 2). Other usage environments call for corresponding embodiments of capacitive mat (not shown) that include support surface geometries conducive to the particular environment.

Figure 5:
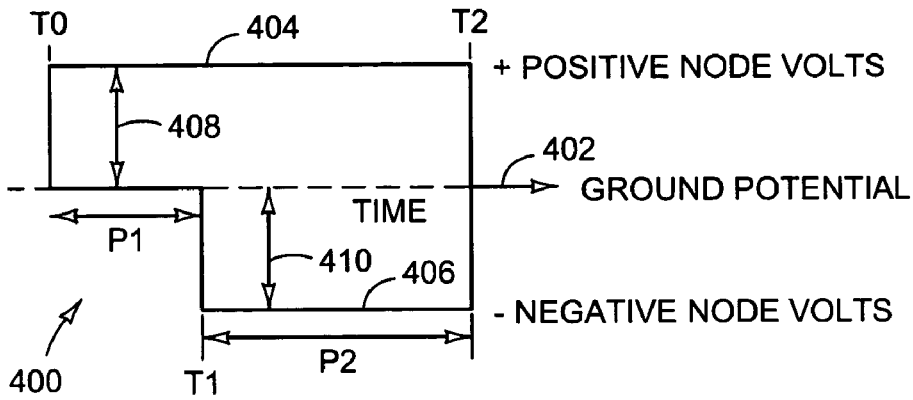
FIG. 5 is a signal timing diagram in accordance with still another embodiment of the present invention.

FIG. 5 is a signal timing diagram (hereafter, timing diagram) 400 in accordance with still another embodiment of the present invention. The timing diagram 400 depicts energization signals (described hereafter) for controllably operating a capacitive mat, such as, for example, the capacitive mats 106, 206 and 306 of respective FIGS. 2, 3 and 4, in accordance with the present invention. The energization signals of the timing diagram 400 are typically provided (i.e., generated or coupled) to a capacitive mat of the present invention by way of a mat controller of the present invention such as, for example, the mat controllers 108, 208 and 308 of respective FIGS. 2, 3 and 4.

The timing diagram 400 includes a ground reference potential line 402. The ground reference potential 402 is any suitable electrical potential or datum from which other relevant signals of the timing diagram 400 are referenced. For purposes herein, the ground reference potential 402 is considered a zero energy level or electrically de-energized state.

The timing diagram 400 also includes an electrical positive node signal 404. The positive node signal 404 is typically coupled to a positive node of a capacitive mat (e.g., positive node 230 of FIG. 3) of the present invention. The timing diagram 400 further includes an electrical negative node signal 406. The negative node signal 406 is typically coupled to a negative node of a capacitive mat (e.g., negative node 232 of FIG. 3) of the present invention.

Normal operation under the timing diagram 400 is as follows: the positive node signal 404 is electrically energized from ground reference potential 402 to a predetermined positive potential 408 at a time "T0". The positive node signal 404 is substantially maintained at this positive potential 408 for a first predetermined period of time "P1"—that is, the period of time P1 can be considered as a wait or "dwell" period.

Thereafter, at a time "T1", the negative node signal 406 is electrically energized from ground reference potential 402 to a predetermined negative potential 410. The positive node potential 404 and the negative node potential 410 are then respectively maintained during a second predetermined wait or dwell period of time "P2".

Thereafter, at a time "T2", both the positive node signal 404 and the negative node signal 406 are substantially simultaneously electrically de-energized, typically by coupling both respective signals 404 and 406 to ground reference potential 402. At this point, one energization cycle or iteration of the timing diagram 400 is considered complete.

The timing diagram 400 provides one method of energizing a capacitive mat (i.e., capacitive mats 106, 206, 306 of respective FIGS. 2, 3 and 4) in accordance with the present invention. In this way, the shifts in energization of the positive node signal 404 and negative node signal 406 that occur at times T0, T1 and T2, respectively, tend to permit an increase of the charge levels occurring on the capacitive mat, with a corresponding increased (i.e., generally sufficient) hold down force, even when some degree of polarization occurs.

Figure 6:
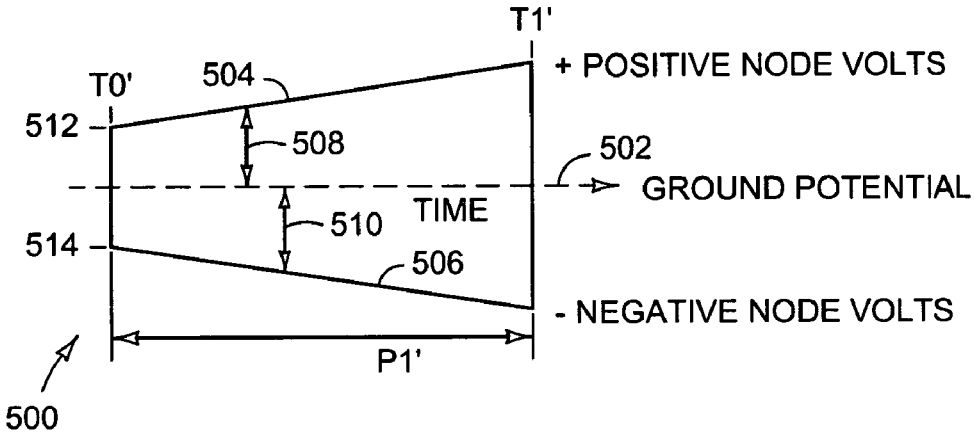
FIG. 6 is a signal timing diagram in accordance with another embodiment of the present invention.

FIG. 6 is a signal timing diagram (hereafter, timing diagram) 500 in accordance with another embodiment of the present invention. The timing diagram 500 includes a ground reference potential line 502, substantially as described above in regard to the ground reference potential line 402 of FIG. 5. Thus, the ground reference potential line 502 is considered a zero-energy reference level or datum within the context of the timing diagram 500.

The timing diagram 500 also includes an electrical positive node signal 504. The positive node signal 504 is generally coupled to a positive node of a capacitive mat (e.g., positive node 230 of FIG. 3) of the present invention. The timing diagram 500 also includes an electrical negative node signal 506. The negative node signal 506 is typically coupled to a negative node of a capacitive mat (e.g., negative node 232 of FIG. 3) of the present invention.

Normal operation under the timing diagram 500 is as follows: the positive node signal 504 and the negative node signal 506 are substantially simultaneously electrically energized to predetermined initial positive and negative potentials 512 and 514, respectively, at time "T0'".

Thereafter, the positive node signal 506 assumes a substantially linear, time-increasing positive potential 508 for a predetermined time period "P1'". Also, the negative node signal 506 assumes a substantially linear, time-increasing negative potential 510 for the predetermined time period P1'. Thus, the respective electrical potentials of the positive node signal 504 and the negative node signal 506 are time-changing in a generally contemporaneous, mirror-image fashion with respect to the ground reference potential line 502.

Then, at a time "T1'", both the positive node signal 504 and the negative node signal 506 are substantially simultaneously electrically de-energized. Generally, this can be accomplished by coupling both respective signals 504 and 506 to ground reference potential 502. At this point, a single iteration of the timing diagram 500 is considered complete.

The timing diagram 500 provides a method of energizing a capacitive mat (i.e., the capacitive mats 106, 206, 306 of respective FIGS. 2, 3 and 4) in accordance with another embodiment of the present invention. The respective time-increasing electrical potentials of the positive node signal 504 and negative node signal 506 tend to substantially reduce the undesirable effects of polarization as described above. That is, generally sufficient hold down force results in accordance with the method as depicted by the timing diagram 500.

Figure 7:
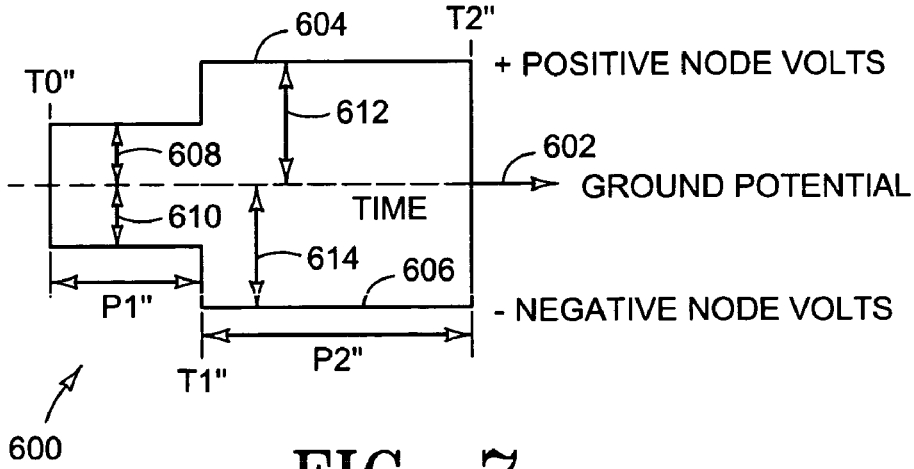
FIG. 7 is a signal timing diagram in accordance with yet another embodiment of the present invention.

FIG. 7 is a signal timing diagram (hereafter, timing diagram) 600 in accordance with yet another embodiment of the present invention. The timing diagram 600 includes a ground reference potential line 602 substantially as described above in regard to the ground reference potential line 402 of FIG. 5.

The timing diagram 600 also includes an electrical positive node signal 604. The positive node signal 604 is typically coupled to a positive node of a capacitive mat (e.g., positive node 230 of FIG. 3) of the present invention. The timing diagram 600 also includes an electrical negative node signal 606. The negative node signal 606 is typically coupled to a negative node of a capacitive mat (e.g., negative node 232 of FIG. 3) of the present invention.

Normal operation under the timing diagram 600 is as follows: at an initial time "T0"", the positive node signal 604 is electrically energized to a first predetermined positive potential 608. Contemporaneously, the negative node signal 606 is electrically energized to a first predetermined negative potential 610. Both the first predetermined positive potential 608 and the second predetermined negative potential 610 are maintained at substantially constant respective levels during a first predetermined time period (i.e., wait, or dwell period) "P1"".

Thereafter, at a time "T1"", the positive node signal 604 is electrically energized (i.e., elevated) to a second predetermined positive potential 612, and the negative node signal 606 is electrically energized to a second predetermined negative potential 614. The second predetermined potentials 612 and 614 are respectively maintained during a second predetermined time period "P2"".

Then, at a later time "T2"", both the positive node signal 604 and the negative node signal 606 are substantially simultaneously de-energized. Such de-energization is typically accomplished by coupling both the positive node signal 604 and the negative node signal 606 to ground reference potential 602. At such a time, a single instance or iteration of the timing diagram 600 is considered complete.

The timing diagram 600 provides a method of energizing a capacitive mat (i.e., capacitive mats 106, 206, 306 of respective FIGS. 2, 3 and 4) in accordance with yet another embodiment of the present invention. The respective changes in the electrical potential of the positive node signal 604 and negative node signal 606 at times T0", T1" and T2" serve to substantially mitigate the undesirable effects of any polarization which may occur within the dielectric cover material (such as, for example, the dielectric cover material 226 of FIG. 3) of the particular capacitive mat controlled under the energization signal method described by the timing diagram 600.

Each of the timing diagrams 400, 500 and 600 described above provides (i.e., depicts) an energization signal method or format of the present invention for use with a capacitive mat (such as the capacitive mats 106, 206, 306 of respective FIGS. 2, 3 and 4). Furthermore, each of the energization signal methods described in the timing diagrams 400, 500 and 600 can be implemented by way of a suitable embodiment of mat controller of the present invention, such as the mat controllers 108, 208, 308 of respective FIGS. 2, 3 and 4.

In this way, the present invention provides a number of suitable control method (i.e., energization signal) embodiments for use in the registration and support of sheet media on a capacitive mat. It is to be understood that other embodiments of the present invention that correspond to other signal timing diagrams (not shown) for use with capacitive mats are also possible within the scope of the present invention.

Such other embodiments of the present invention can include any suitable combination of the capacitive mat energization characteristics described above in regard to those of the timing diagrams 400, 500 and 600, including, for example, step changes and/or time variations in electrical potential. Some of the embodiments of the present invention are further described in the context of sequential methodologies hereafter.

Figure 8:
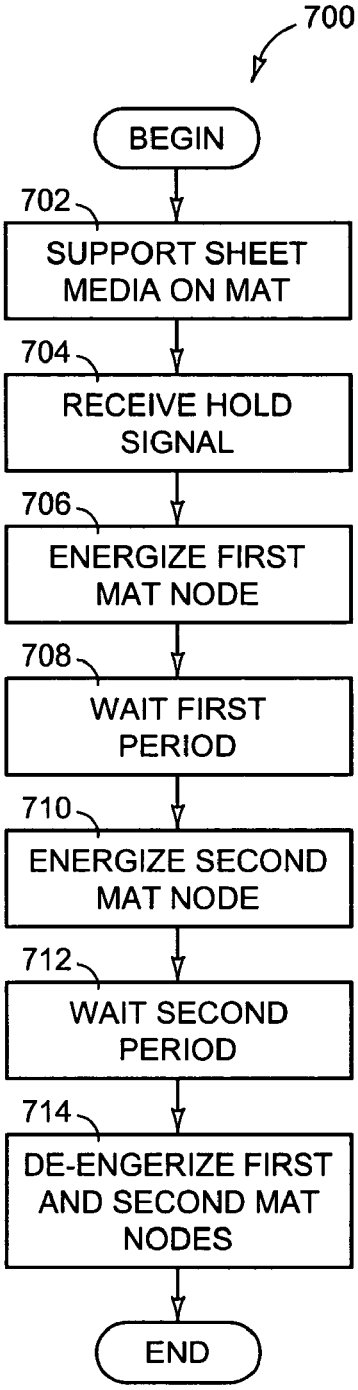
FIG. 8 is a flowchart depicting a method in accordance with still another embodiment of the present invention.

FIG. 8 is a flowchart depicting a method 700 of controlling a capacitive mat in accordance with still another embodiment of the present invention. For clarity, the method 700 is described with reference to the imaging apparatus 100 of FIG. 2 and the capacitive mat 206 of FIG. 3. It is to be understood, however, that the method 700 can be suitably used in conjunction with other embodiments of the present invention.

In step 702 (FIG. 8), it is assumed that a sheet of media S (FIG. 2) is brought into resting support on the capacitive mat 106.

In step 704 (FIG. 8), the mat controller 108 (FIG. 2) receives a hold-down (or tacking) signal from the imaging apparatus controller 102.

In step 706 (FIG. 8), the mat controller 108 (FIG. 2) responds to the hold-down signal and energizes the first node 222 (FIG. 3) of the capacitive mat 106 (FIG. 2) at a predetermined positive potential or level.

In step 708 (FIG. 8), the mat controller 108 (FIG. 2) continues to energize the first node 222 (FIG. 3) as established in step 706 (FIG. 8) above during a first wait or dwell period.

In step 710 (FIG. 8), the mat controller 108 (FIG. 2) energizes a second node 224 (FIG. 3) of the capacitive mat 106 (FIG. 2) at a predetermined negative potential.

In step 712 (FIG. 8), the mat controller 108 (FIG. 2) continues to energize both the first node 222 (FIG. 3) and the second node 224 as established in steps 706 (FIG. 8) and 710 above during a second predetermined wait period.

In step 714 (FIG. 8), the mat controller 108 (FIG. 2) de-energizes both the first node 222 (FIG. 3) and the second node 224 of the capacitive mat 106 (FIG. 2). Typically, this is done by coupling the nodes 222 (FIG. 3) and 224 to a ground reference potential. In any case, the method 700 is now considered complete.

Figure 9:
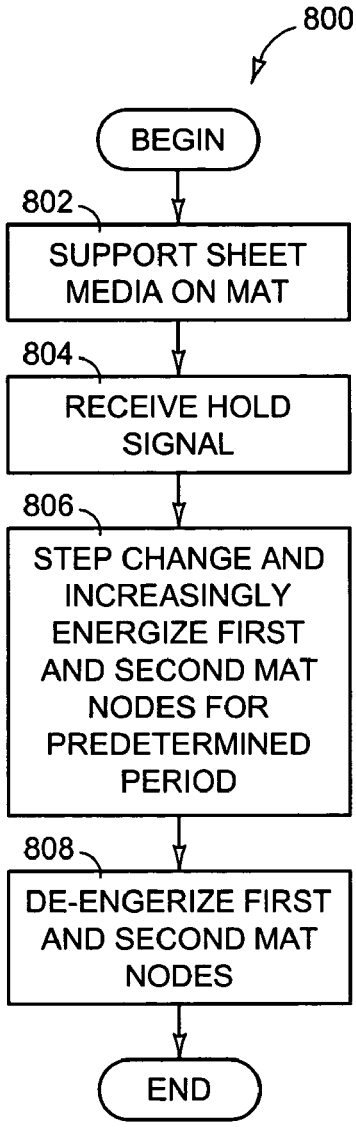
FIG. 9 is a flowchart depicting a method in accordance with another embodiment of the present invention.

FIG. 9 is a flowchart depicting a method 800 of controlling a capacitive mat in accordance with still another embodiment of the present invention. In the interest of clarity, the method 800 is also described with reference to the imaging apparatus 100 of FIG. 2 and the capacitive mat 206 of FIG. 3. It is to be understood, however, that the method 800 can be suitably used in conjunction with other embodiments of the present invention.

In step 802 (FIG. 9), a sheet of media S (FIG. 2) is assumed to be brought into resting support with the capacitive mat 106.

In step 804 (FIG. 9), the mat controller 108 (FIG. 2) receives a hold-down signal from the imaging apparatus controller 102.

In step 806 (FIG. 9), the mat controller 108 (FIG. 2) responds to the hold-down signal by simultaneously energizing the first node 222 (FIG. 3) and the second node 224 of the capacitive mat 106 (FIG. 2) with respective first predetermined electrical potentials, with the first node 222 (FIG. 3) potential being positive relative to that of the second node 224. Immediately thereafter, the mat controller 108 (FIG. 2) applies a time-increasing potential difference to the nodes 222 (FIG. 3) and 224. This application of time-increasing potential difference is continued by the mat controller 108 (FIG. 2) for a predetermined period of time.

In step 808 (FIG. 9), the mat controller 108 (FIG. 2.) de-energizes both the first node 222 (FIG. 3) and the second node 224 of the capacitive mat 106 (FIG. 2). Generally, this is accomplished by coupling the nodes 222 (FIG. 3) and 224 to a ground reference potential. The method 800 is now complete.

Figure 10:
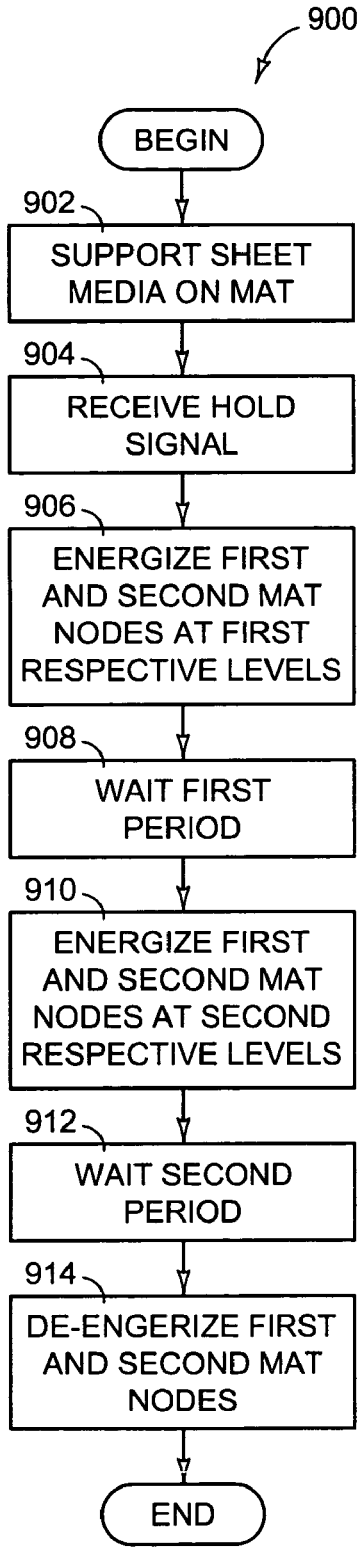
FIG. 10 is a flowchart depicting a method in accordance with yet another embodiment of the present invention.

FIG. 10 is a flowchart depicting a method 900 in accordance with yet another embodiment of the present invention. While the method 900 is described with reference to the imaging apparatus 100 of FIG. 2 and the capacitive mat 206 of FIG. 3, it is to be understood that the method 900 can be suitably used in conjunction with other embodiments of the present invention.

In step 902 (FIG. 10), a sheet of media S (FIG. 2) is brought into resting support on the capacitive mat 106.

In step 904 (FIG. 10), the mat controller 108 (FIG. 2) receives a hold-down signal from the imaging apparatus controller 102.

In step 906 (FIG. 10), the mat controller 108 (FIG. 2) responds to the hold-down signal by simultaneously energizing the first node 222 (FIG. 3) and the second node 224 of the capacitive mat 106 (FIG. 2) with respective first predetermined electrical potentials, with the first node 222 (FIG. 3) potential being positive relative to that of the second node 224.

In step 908 (FIG. 10), the mat controller 108 (FIG. 2) waits for a first predetermined period of time. During this time the respective energization levels of the first node 222 (FIG. 3) and the second node 224 are substantially maintained as established in step 906 (FIG. 10) above.

In step 910 (FIG. 10), the mat controller 108 (FIG. 2) simultaneously changes the energization of the first node 222 (FIG. 3) and the second node 224 to second respective predetermined potential levels. In this way, the electrical potential between the first node 222 and the second node 224 is typically increased relative to that established in step 906 (FIG. 10) above.

In step 912 (FIG. 10), the mat controller 108 (FIG. 2) waits for a second predetermined period of time. During this time the respective energization levels of the first node 222 (FIG. 3) and the second node 224 are maintained substantially as established in step 910 (FIG. 10) above.

In step 914 (FIG. 10), the mat controller 108 (FIG. 2.) de-energizes both the first node 222 (FIG. 3) and the second node 224 of the capacitive mat 106 (FIG. 2). This is usually accomplished by coupling the nodes 222 (FIG. 3) and 224 to a ground reference potential. The method 900 is now considered to be complete.

While the methods 700, 800 and 900 of FIGS. 8-10 above respectively describe particular method steps and order of execution, it is to be understood that other methods (not shown) consistent with other embodiments of the present invention can also be used. Other such methods (not shown) can include suitable combinations of these or other steps performed in correspondingly suitable orders of execution.

Thus, the present invention provides a number of methods and apparatuses that are directed to substantially reducing polarization (i.e., electric charge accumulation) within the dielectric cover material of the capacitive mat thus controlled. In this way, the methods and apparatuses of the present invention provide for the ongoing controlled operation of capacitive mats in a manner that is generally free from a loss of hold-down or tacking force with respect to the supported sheet media.

While the above methods and apparatus have been described in language more or less specific as to structural and methodical features, it is to be understood, however, that they are not limited to the specific features shown and described, since the means herein disclosed comprise preferred forms of putting the invention into effect. The methods and apparatus are, therefore, claimed in any of their forms or modifications within the proper scope of the appended claims appropriately interpreted in accordance with the doctrine of equivalents.

We claim:

1. A sheet media support apparatus, comprising a capacitive mat including electrical first and second nodes; and a controller coupled to the first and second nodes of the capacitive mat and configured to:

selectively electrically energize the first node at a step-change positive potential, waiting a predetermined amount of time, and electrically energize the second node at a step-change negative potential after expiration of the predetermined amount of time.

2. The apparatus of claim 1, and wherein the capacitive mat includes:

a first plurality of electrical conductors electrically coupled to the first node; and a second plurality of electrical conductors electrically coupled to the second node.

3. The apparatus of claim 1, and wherein the capacitive mat defines a curved sheet media support surface.

4. The apparatus of claim 1, and wherein the capacitive mat and the controller are each further configured to cooperate with an imaging apparatus.

* * * * *